US005170776A

United States Patent [19]

Pecheux

[11] Patent Number: 5,170,776

[45] Date of Patent: Dec. 15, 1992

[54] APPARATUS FOR CONTINUOUS PASSIVE ARTICULAR MOBILIZATION OF THE FOOT

[76] Inventor: Jean-Claude R. Pecheux, 100bis rue de Saint-Quentin, 08090 Aiglemont, France

[21] Appl. No.: 460,975

[22] PCT Filed: Jul. 7, 1989

[86] PCT No.: PCT/FR89/00358

§ 371 Date: Mar. 7, 1990

§ 102(e) Date: Mar. 7, 1990

[87] PCT Pub. No.: WO90/00383

PCT Pub. Date: Jan. 25, 1990

[30] Foreign Application Priority Data

Jul. 8, 1988 [FR] France ..... 88 09701
Jun. 23, 1989 [FR] France ..... 89 08654

[51] Int. Cl.[5] ..... A61H 1/02

[52] U.S. Cl. ..... 128/25 B; 128/48; 128/51; 128/25 R

[58] Field of Search ..... 128/25 R, 25 B, 26, 128/44, 45, 48, 49, 51, 52; 272/96; 482/79, 80

[56] References Cited

U.S. PATENT DOCUMENTS 2,206,902 4/1935 Kost .
2,216,764 10/1940 Clark ..... 128/25 B
2,591,212 12/1947 Stauffer .
4,199,137 4/1980 Giguére ..... 128/25 B X
4,306,714 12/1981 Loomis et al. .
4,337,939 7/1982 Hoyle et al. .
4,452,447 6/1984 Lepley et al. .
4,650,183 3/1987 McIntyre ..... 128/25 B X
4,733,859 3/1988 Kock et al. ..... 128/25 B X
4,767,118 8/1988 Ostergard .
4,807,874 2/1989 Little .
4,842,265 6/1989 Kirk ..... 128/25 B
4,862,875 9/1989 Heaton ..... 128/25 B

FOREIGN PATENT DOCUMENTS 73.15334 11/1974 France .
725666 12/1980 U.S.S.R. .
1293796 10/1972 United Kingdom .

OTHER PUBLICATIONS

"Bowen Fracture Appliances" Advertisement; *Journal of Bone & Joint Surgery*, vol. 46-A #3, Apr. 1964.

*Primary Examiner*—Richard J. Apley
*Assistant Examiner*—Linda C. M. Dvorak
*Attorney, Agent, or Firm*—Bacon & Thomas

[57] ABSTRACT

Apparatus for passive articular mobilization of a foot includes a sole element mounted on a base for articulation about three independent orthogonal axes including a varus-valgus axis extending generally perpendicular to the base, a flexion axis, an abduction-adduction axis intersecting both the varus-valgus and flexion axes and extending generally parallel to the base. A single reversible drive motor is mounted on the base and is attached to the sole element by a transmission system including levers for reversibly moving the sole element selectively and simultaneously about the three orthogonal axes in response to motor actuation. The transmission system includes a movable carriage that can be driven rectilinearly or rotatably relative to the base. The effective length of the levers is adjustable so that, upon actuation of the motor, the sole element can be adjusted to a desired corrective position.

22 Claims, 12 Drawing Sheets

APPARATUS FOR CONTINUOUS PASSIVE ARTICULAR MOBILIZATION OF THE FOOT

TECHNICAL DOMAIN

The invention concerns the technical domain of articular mobilization with a view to the orthopaedic correction of the foot.

The apparatus makes it possible to mobilize the osteo-articular assembly constituted by the foot in the three perpendicular planes in space (FIG. 1).

It allows:

1) flexion-extension of the ankle about axis AA', 2) varus-valgus of the talocalcanean joint about axis BB', 3) abduction-adduction about axis CC'.

This apparatus is particularly intended for the continuous passive mobilization of talipes equinus in the newborn baby.

Talipes equinus is a deformation of the foot consecutive to an intra-uterine malposition. According to Professor Ombredanne's analysis, the deformation of the talipes equinus is effected in the three perpendicular planes in space, as illustrated for a left foot in FIGS. 2 to 7.

1) in the saggital (or antero-posterior vertical) plane, the foot is deformed in EQUINUS (FIG. 2), i.e. the whole of the foot pivots in plantar flexion with respect to the leg to form a forwardly open sine obtuse angle.

2) in the frontal plane, the foot is deformed in VARUS, i.e. the sole of the foot faces the median axis of the body (FIG. 3).

3) in the horizontal plane, the foot is deformed in ADDUCTION (FIG. 5), i.e. its longitudinal (antero-posterior) axis is directed towards the median axis of the body.

All things considered, using the metaphor of a boat, the talipes equinus pitches, rolls and veers.

PRIOR ART

So-called mechano-therapy apparatus are known which allow the active or activo-passive mobilization of the foot in the three perpendicular axes in space (so-called FRANCO apparatus).

This apparatus does not come within the concept of continuous passive articular mobilization.

The originality of the apparatus according to the invention resides in its capacity of conducting a continuous passive mobilization of the foot in:

1) isolated valgus-varus (axis BB' FIG. 1), 2) valgus-varus concomitant with abduction-adduction (axis BB' and CC' FIG. 1), 3) isolated dorsal flexion-plantar flexion (axis AA' FIG. 1), 4) dorsal flexion-plantar flexion concomitant with the valgus-varus (axis AA' and BB' FIG. 1), 5) dorsal flexion-plantar flexion concomitant with the valgus-varus and with the abduction-adduction (axes AA', BB' and CC' FIG. 1), 6) isolated abduction-adduction (axis CC' FIG. 1).

In summary, the three axes of deformation may be mobilized separately or simultaneously.

The object of the invention is to provide such an apparatus which makes it possible to effect the orthopaedic correction of this trouble by fighting against the deformation.

From the therapeutic point of view, the orthopaedic correction of this trouble consists in fighting against:

1) supination of the fore-foot and of the rear foot, and which is the resultant of varus and adduction.

2) equinus: the apparatus makes it possible to correct the first deformation by mobilizing the foot in pronation (=valgus+abduction) and the second deformation by mobilizing the foot in dorsal flexion (axis AA' FIG. 1).

The apparatus makes it possible to correct one or the other deformation or the two simultaneously.

STATEMENT OF THE INVENTION

In order to attain the above objectives, the apparatus according to the invention is characterized in that it comprises on a foot base, on the one hand, an articulated sole system comprising a sole borne by supports articulated to give said sole three degrees of orientation adjustable on the orthogonal axes of flexion, of abduction-adduction and of varus-valgus, on the other hand, a drive member of the rotating type and, furthermore, a transmission system incorporating adjustable rods connecting the drive member to the articulated sole system.

Various other characteristics will appear from the following description made with reference to the accompanying drawings which show, by way of non-limiting examples, embodiments of the object of the invention.

BRIEF DESCRIPTION OF THE DRAWINGS

FIG. 8 is a schematic perspective view of a first embodiment of the apparatus.

DETAILED DESCRIPTION OF PREFERRED EMBODIMENTS

Chronologically, it is important to begin by correcting the fore-foot and the rear foot in pronation, before reducing the equinus, thus the conductor axis of the apparatus will be that which corrects supination.

The introduction of the fight against equinus, by the associated or isolated mobilization in dorsal flexion, is to be effected only secondarily, after the correction of the first deformation.

The apparatus according to the invention is characterized in that it is constituted by an assembly comprising a sole 1 (FIGS. 8 and 9) orientable on an axis of abduction-adduction CC' and borne by a first support 3 orientable by an axis of dorsal flexion-plantar flexion AA' on a second support 4 orientable by an axis of valgus-varus BB' on a base.

The apparatus is principally composed of an articulated sole system I, of a drive member II fixed on its base S and of connecting arms or levers III.

Figure 9:
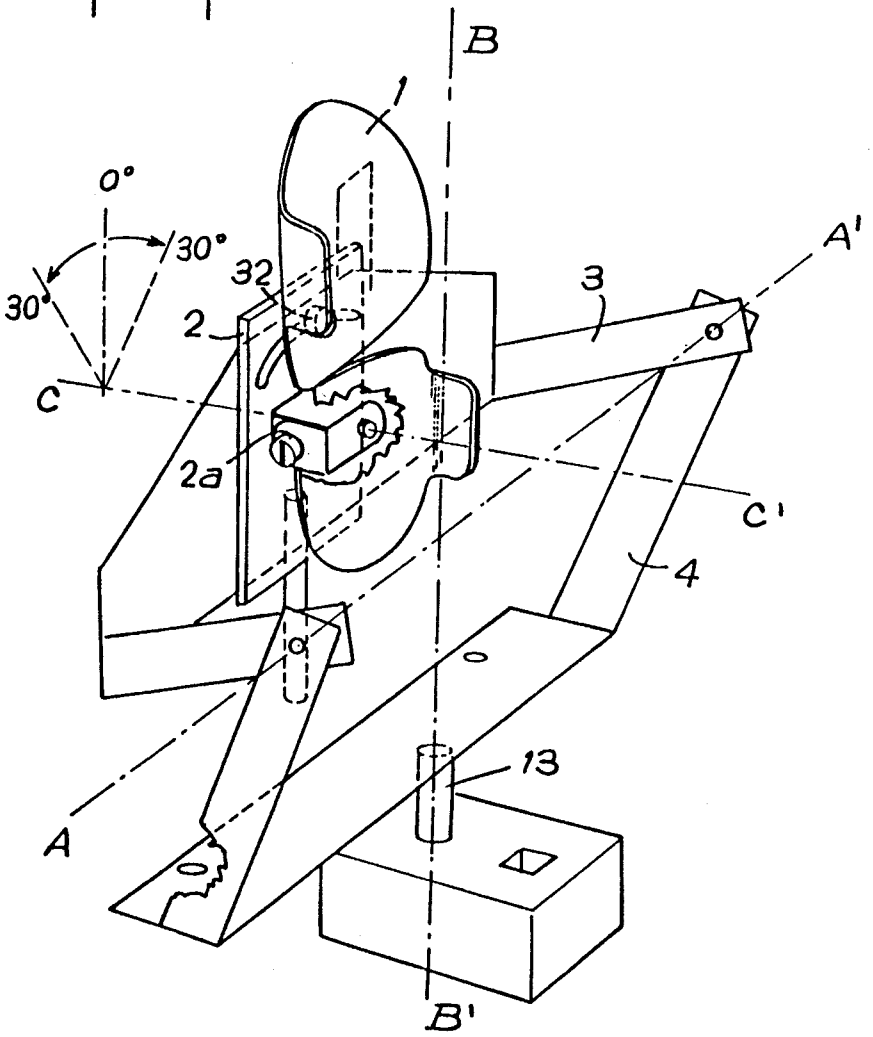
FIG. 9 is a perspective view, with parts torn away, on a larger scale, of one of the constituent elements of the apparatus.

The articulated sole system I comprises the sole 1 proper which is either a conventional sole of Denis Browne splint type, or a sole of plastics material with supple cellular foam coating absorbing the pressures of the foot, or a sole correcting the adductus of the forefoot, as illustrated in FIG. 9.

The foot is fixed on these various soles by means of setting bands available on the market.

The sole 1 is fixed on the sole-holder 2 on which it is orientable thanks to two angle irons 2*a* movable in two perpendicular planes (dorsal flexion-plantar flexion and abduction-adduction).

The sole-holder 2 is mobile on axis BB' by a pivot 13, is orientable by 30° in abduction or in adduction and is blocked by a screw 32 (FIG. 10) on a U-shaped stirrup 3, mobile about axis AA'. The stirrup 3 brings about dorsal flexion-plantar flexion and is mounted on a U-shaped stirrup 4 mobile about axis CC' which causes valgus-varus.

The drive member II comprises a gear motor 5 proper, a guide composed of a rod 6 and a screw 7 mounted on bearings 8 and 9, a mobile carriage 10, a system for reversing the direction of working of the motor, constituted either by a tacho-generator 11, or an electro-mechanical or opto-electrical reversal device 12, or a reading potentiometer located on axis BB' 13.

Working of the apparatus is ensured by an electronic control and by a desk on which are displayed the conventional known functions for passive articular mobilization apparatus (amplitude, speed, force, etc.).

Figure 10:
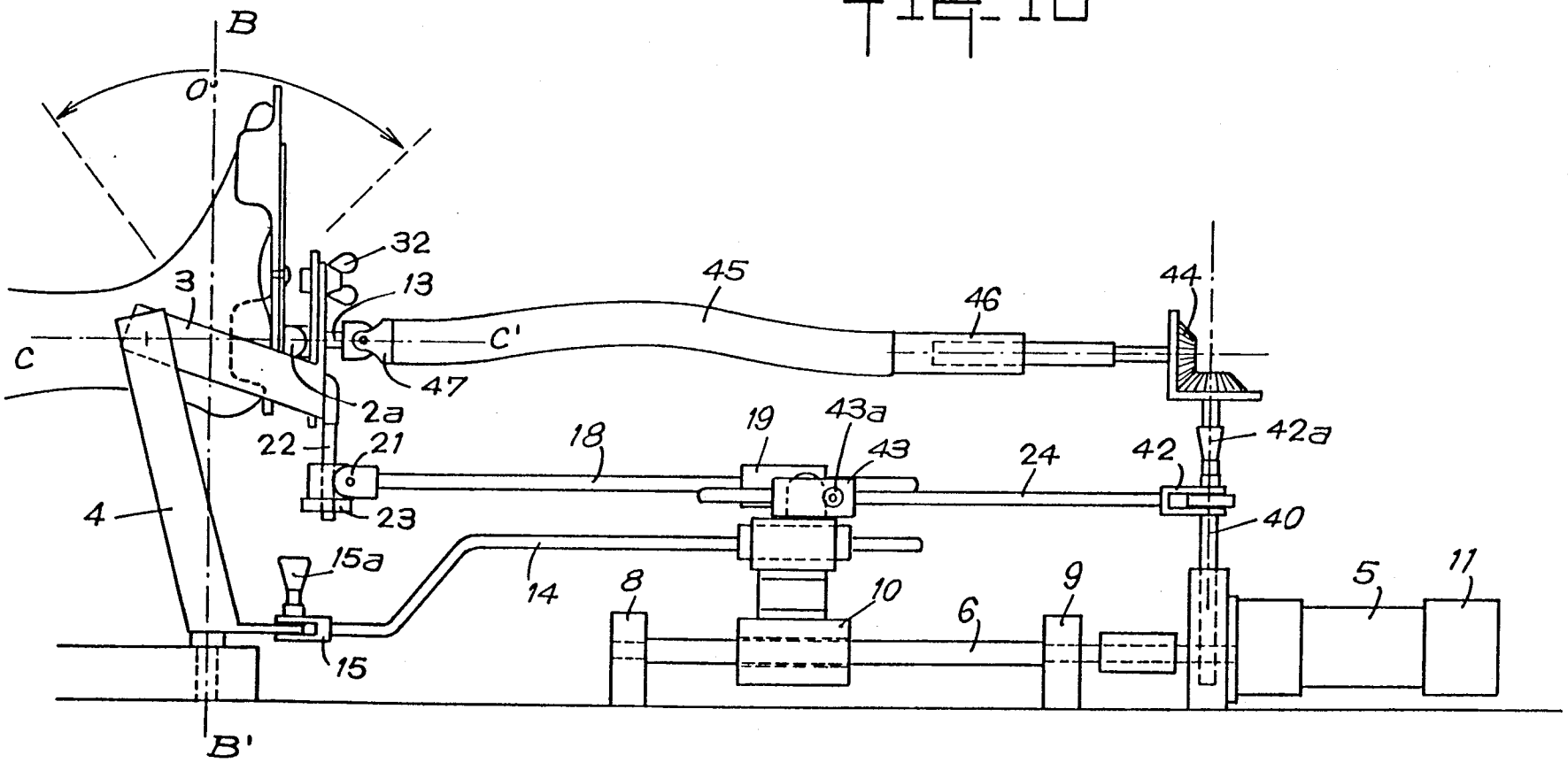
FIG. 10 is a side view of the apparatus.
Figure 11:
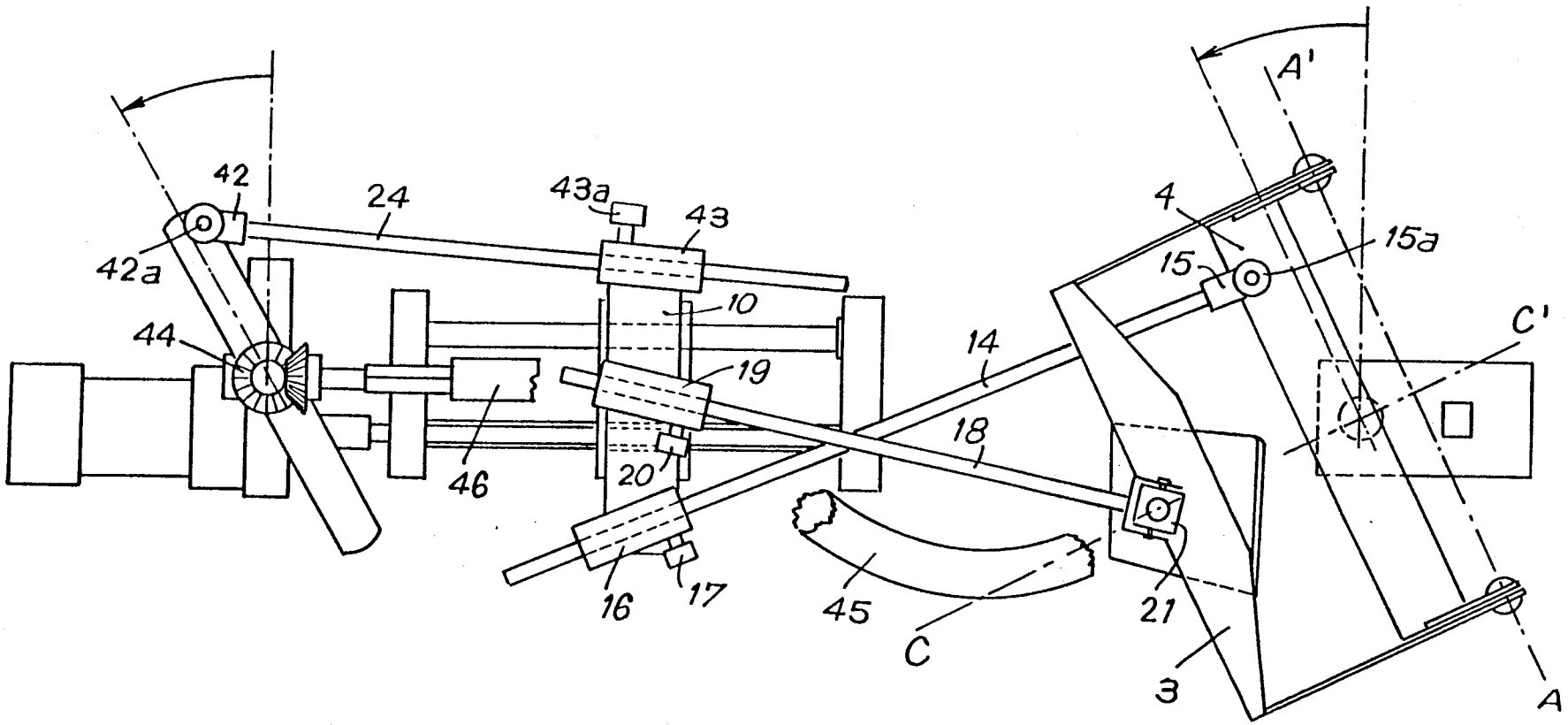
FIG. 11 is a schematic plan view corresponding to FIG. 1 and showing a phase of operation.

The connecting arms or levers III comprise, according to FIGS. 8, 10 and 11, a principal lever 14 connecting the mobile carriage 10 to the U-shaped stirrup 4. The lever brings about valgus and is positioned and articulated by means of a fork-joint 15, provided with a screw or an indexer 15*a*, on one or the other side of the stirrup 4 depending on whether it is desired to mobilize the left foot or the right. Lever 14 is fixed to the mobile carriage by means of pivot 16. The movement may be stopped by loosening the adjusting screw 17.

Levers III also comprise a lever 18 which brings about dorsal flexion-plantar flexion. This lever is connected:

on the one hand, to the mobile carriage 10 by the pivot 19 provided with an adjusting screw 20 (the movement may be stopped by loosening this screw), on the other hand, to the U-shaped stirrup 3 by the pivot 21 which is positioned on the slide 22 and is retained by screw 23. Slide 22 serves to adjust the relative clearance of the dorsal flexion-plantar flexion, with respect to the valgus-varus.

Levers III comprise a third lever 24 which is positioned on the mobile carriage 10 and actuates a system IV for driving the sole in abduction-adduction.

System IV comprises pivot 40 (FIGS. 8, 10 and 11) driven in rotation by lever 24 which is articulated, on the one hand, on one or the other arm of the pivot 40 depending on whether the right or left foot is mobilized (it is fixed by means of the fork joint 42 provided with a screw or an indexer 42*a*) and, on the other hand, on the mobile carriage by means of pivot 43 provided with an adjusting screw 43*a* (FIG. 10). By loosening this screw, the movement is stopped.

Pivot 40 of system IV extends in a bevel gear 44 itself extended by a device for driving in rotation constituted by a flexible cable 45, a slide 46 and a Universal joint 47 fast with the shaft of the sole-holder.

The flexible cable may be replaced by a rigid arm with two Universal joints.

Figure 1:
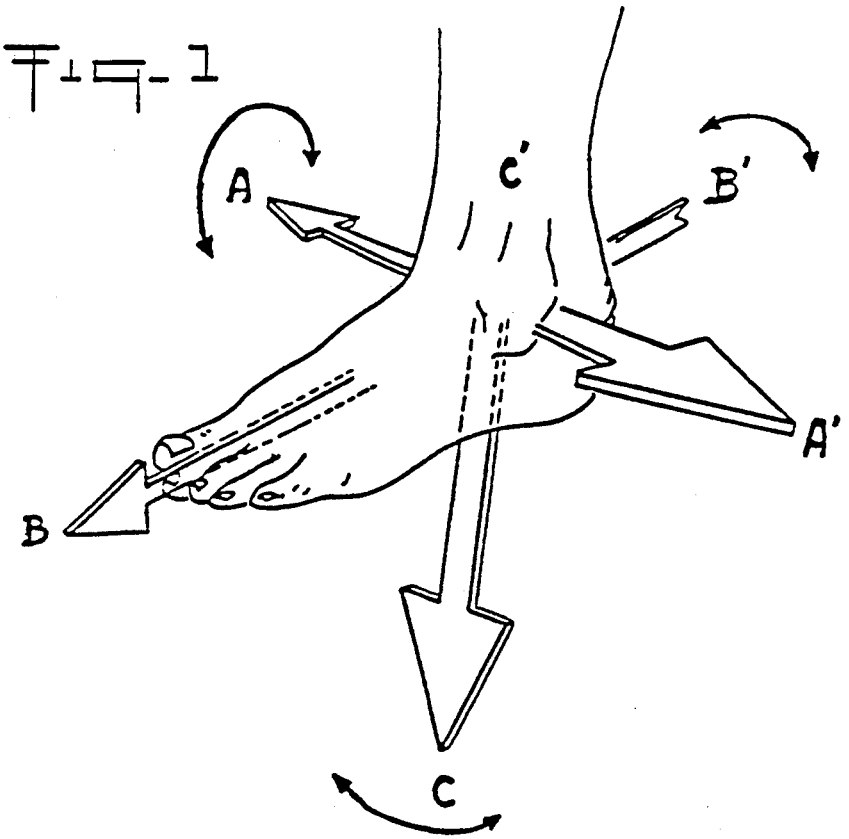
FIGS. 1 to 7 are schematic views showing certain of the anatomical aspects of the articular assembly of the foot.
Figure 2:
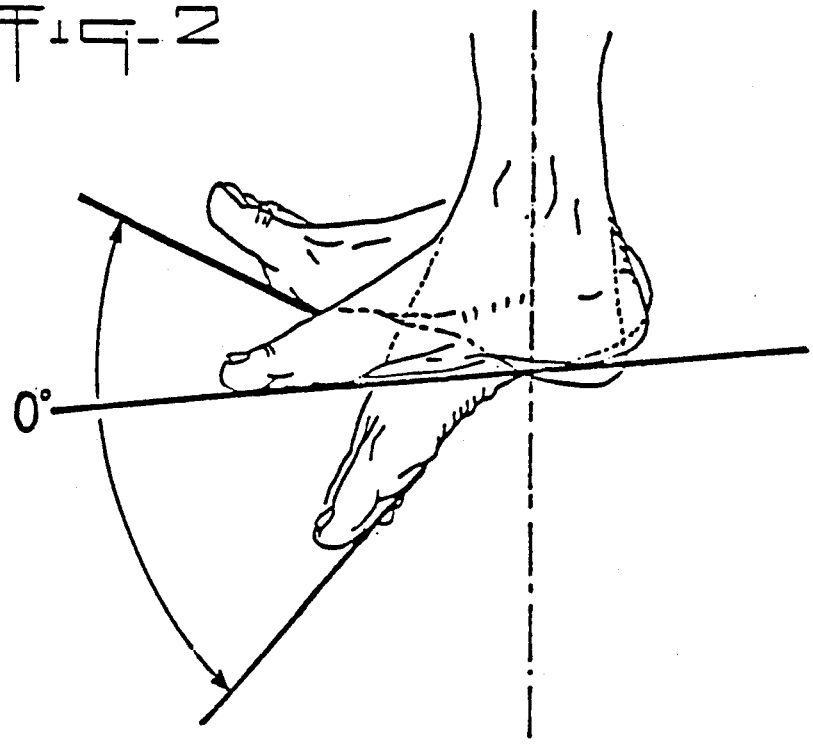
Figure 3:
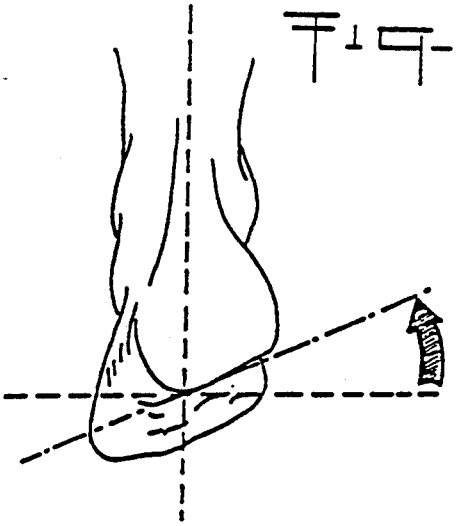
Figure 4:
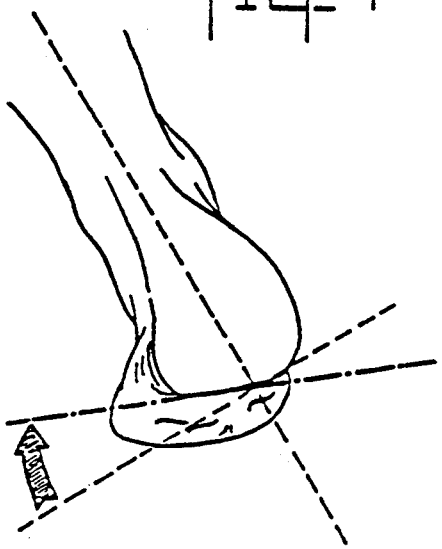
Figure 5:
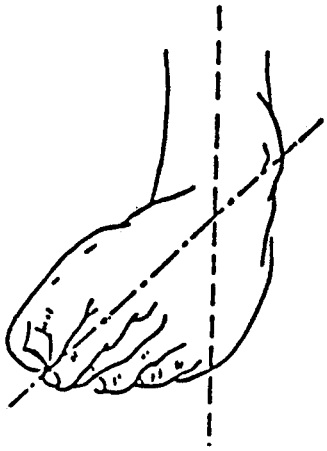
Figure 6:
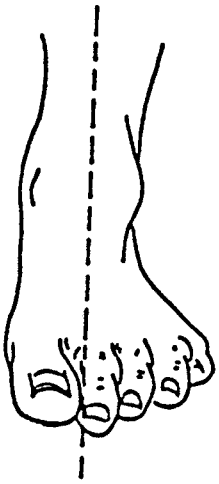
Figure 7:
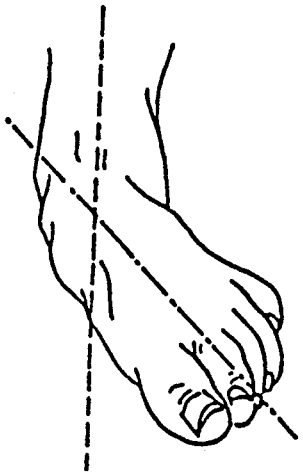
Figure 4:
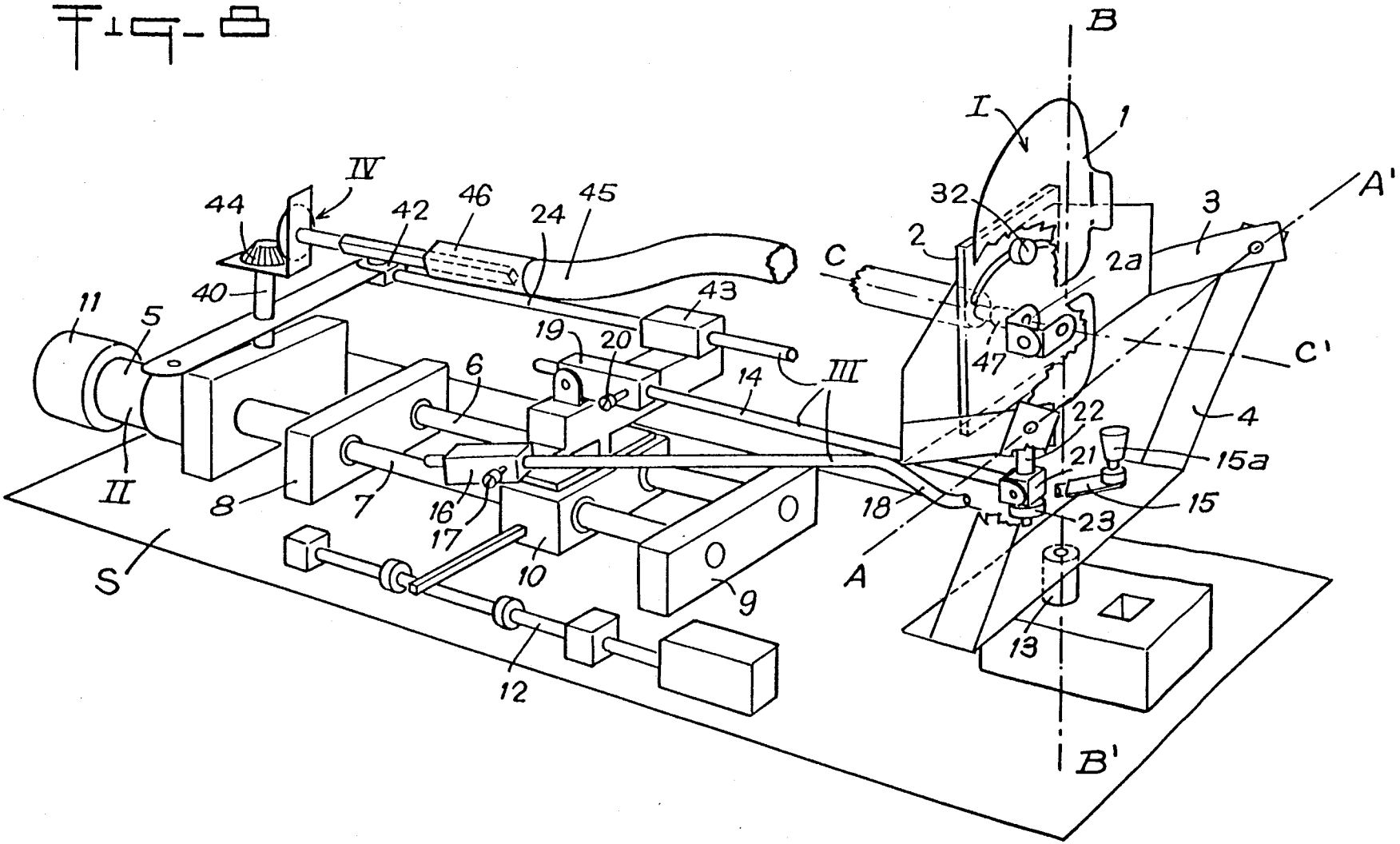

The apparatus operates as follows:

From the physiological position ZERO (FIGS. 1 and 6), the apparatus may develop:

1) a mobilization of the foot in valgus by an amplitude of 0° to 30° causing the stirrup 4 to pivot on axis BB' by the lever 14 drawn by the mobile carriage.

2) a mobilization of the foot in dorsal flexion by 0° to 40°, causing the stirrup 3 to pivot on axis AA' by lever 18 controlled by carriage 10.

3) a mobilization of the foot in abduction by 0° to 30°, causing the sole 1 to pivot on axis CC' by system IV.

4) a concomitant mobilization of the foot in valgus and in dorsal flexion by causing stirrup 4 to pivot on axis BB' by lever 14 and stirrup 3 on axis AA' by lever 18, simultaneously.

5) a concomitant mobilization of the foot in valgus and in abduction by causing the stirrup 4 to pivot on axis BB' by lever 14 and sole 1 on axis CC' by system IV, simultaneously.

6) a concomitant mobilization of the foot in valgus dorsal flexion-abduction, causing the three axes AA', BB' and CC' to pivot by means of their respective levers 14 and 18, as well as by system IV.

Figure 12:
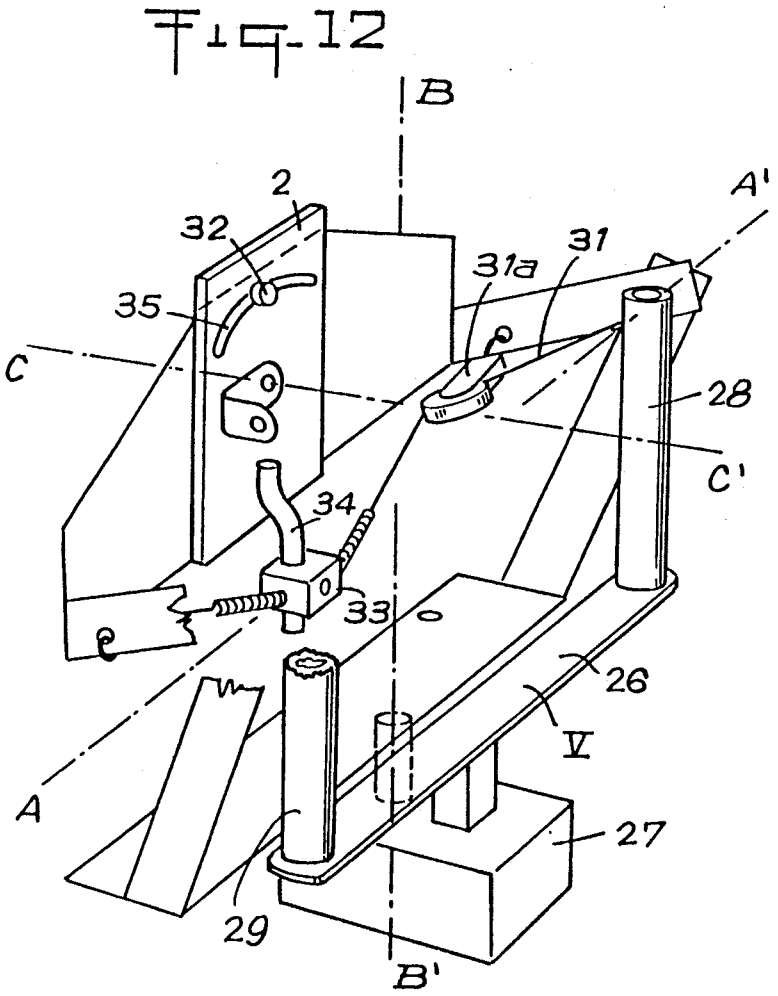
FIG. 12 is a partial perspective view, with parts torn away, of a variant.

The apparatus may also comprise a system V allowing abduction on axis CC' concomitantly with the valgus on axis BB'. This system V comprises (FIGS. 12 to 14), a U-shaped stirrup 26 fixed on the base 27 bearing axis CC'; the arms 28 and 29 of the stirrup 26 are connected to the sole-holder 2 by a double right and left circuit of elastic cables 31 mounted on guide pulleys 31*a*.

The fastening bolt 32 makes it possible to unblock the sole-holder 2 which may then pivot on its axis CC'.

The elastic cables 31 are mounted on the traveller 33. As the valgus develops by rotation of the stirrup 4 on its axis BB', the sole-holder 2 pivots about its axis CC'.

By adjusting the position of the traveller 33 on the rod 34, a maximum of in the manner of an adjustable throw crank abduction may be obtained for a clearance in valgus of 30°.

Figure 13:
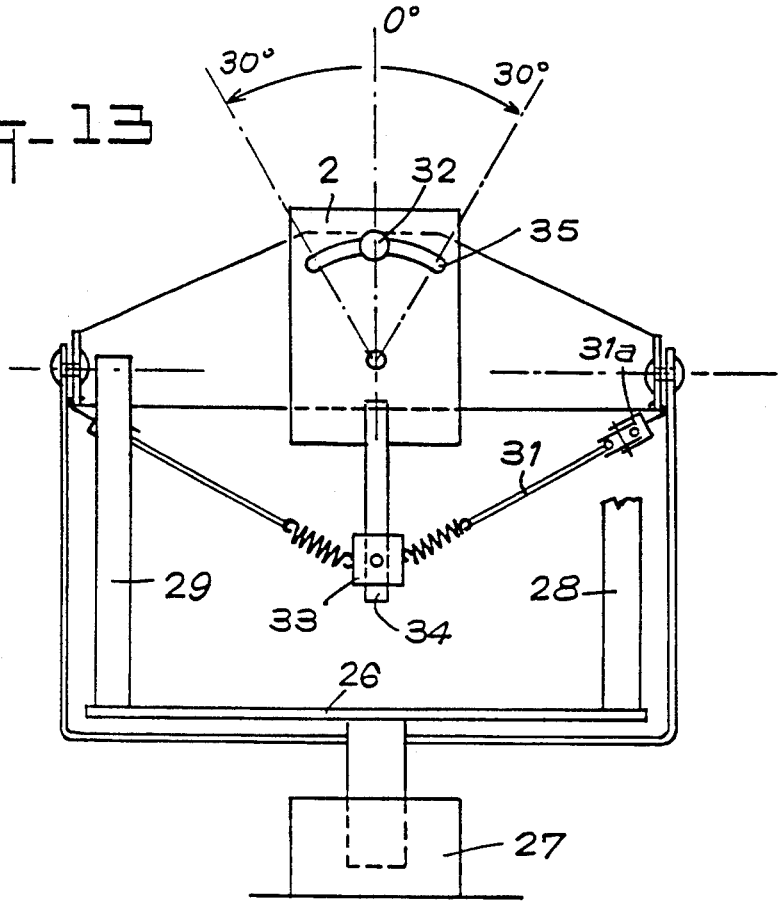
FIG. 13 is a side view of the variant according to FIG. 12.
Figure 14:
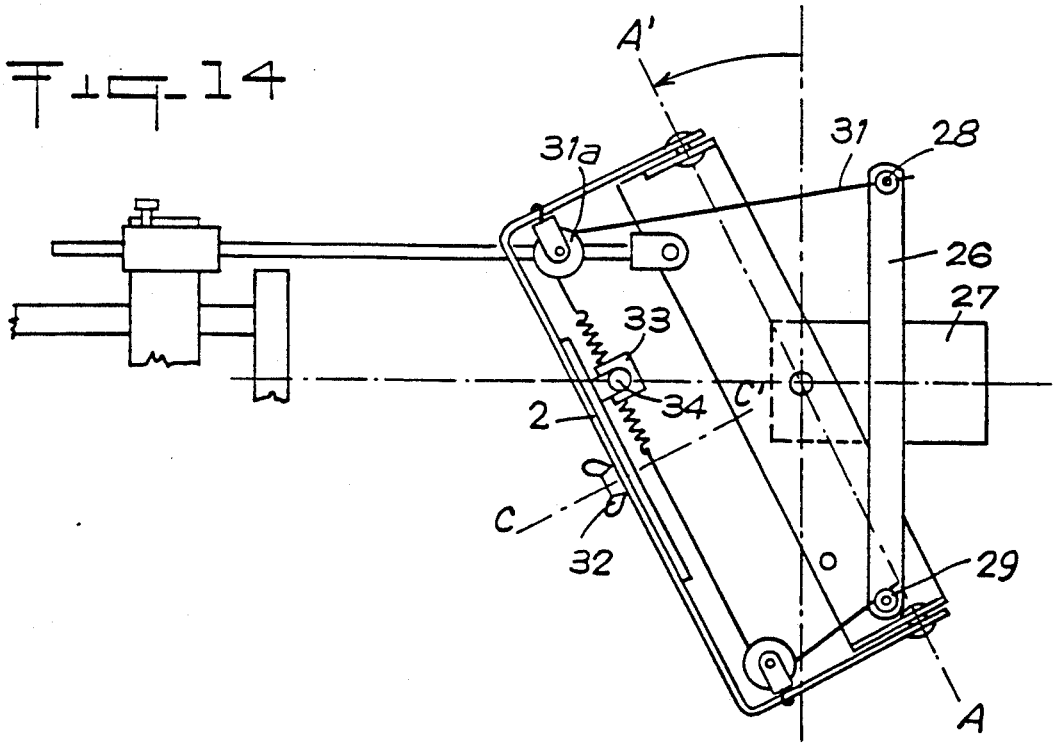
FIG. 14 is a plan view of the variant according to FIG. 12.

The screw 32 then abuts at the end of the groove 35, as shown in FIG. 13.

BEST MANNER OF CARRYING OUT THE INVENTION

Figure 15:
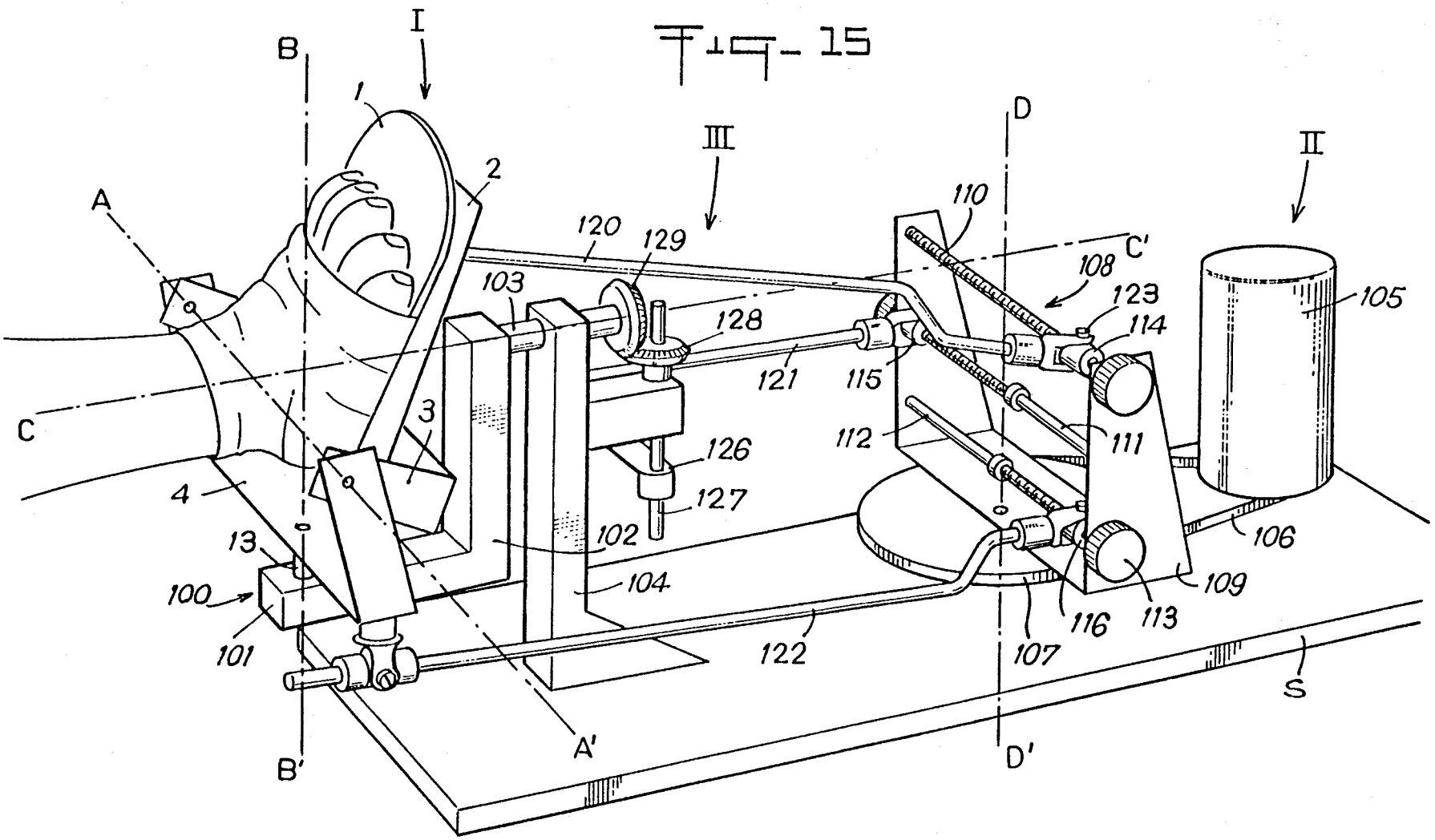
FIG. 15 is a perspective view of another embodiment.
Figure 16:
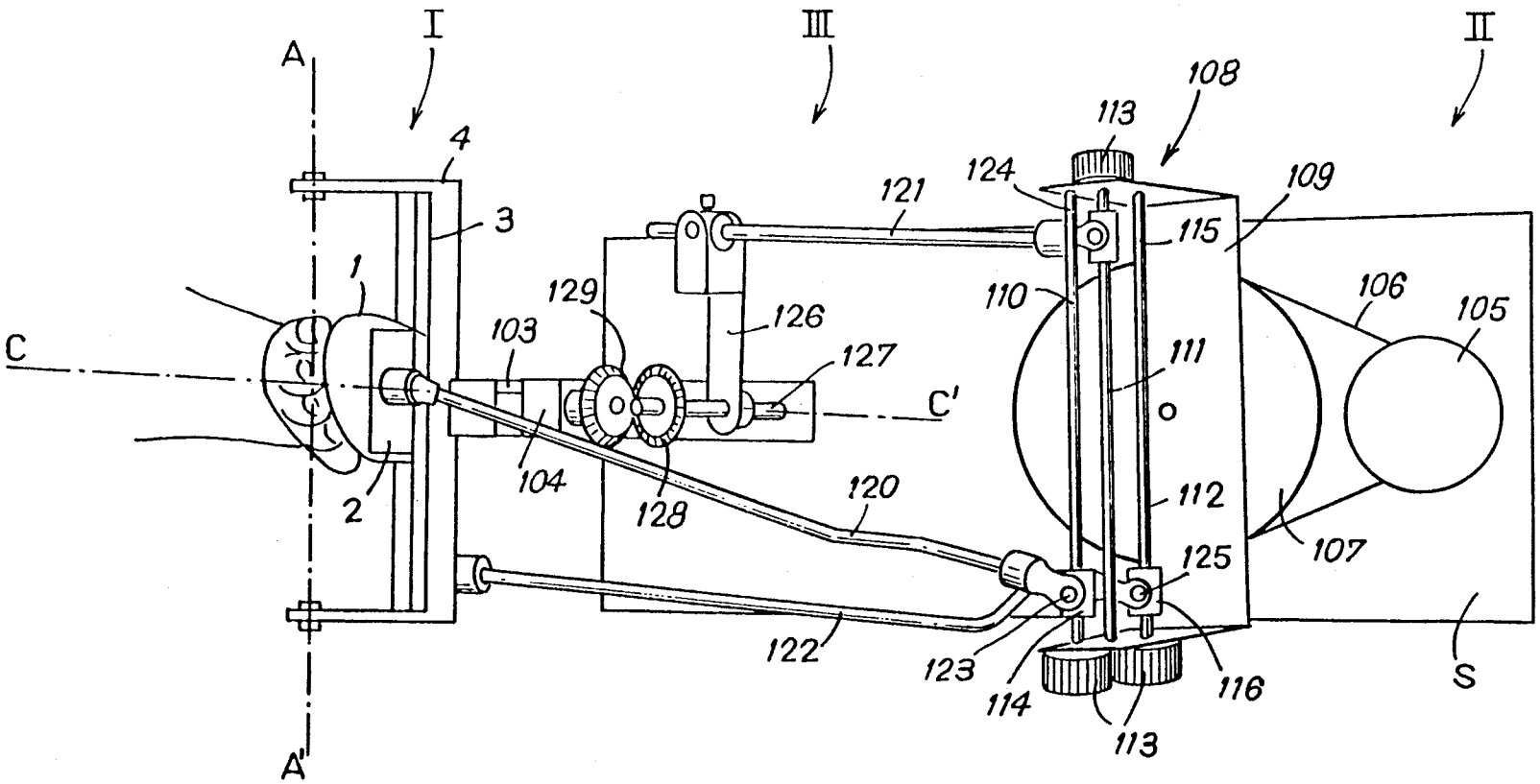
FIG. 16 is a plan view corresponding to FIG. 15.

According to another embodiment illustrated in FIGS. 15 and 16, the pivot 13 or journal is borne by a suspension piece 100 advantageously made in the form of an angle of which arm 101 bears journal 13. Arm 102 of angle 100 is suspended by an articulation pivot 103 on the upper end of a column 104 upstanding from base 1. The articulation pivot 103 is coaxial to axis CC' and is preferably constituted by a rotating shaft traversing the upper part of column 104. Arm 102 is fixed, on the constituent shaft of pivot 103 in any appropriate manner to be angularly immobilized on the latter, whilst being able to be easily disconnected therefrom. Sole 1 is adapted on the sole-holder 2 so that, in the state of rest of the apparatus, the articulation pivot 103 or axis C' merges with the centre of the physiological joint of the foot.

Drive assembly II is constituted by a gear motor unit 105, with double direction of rotation, preferably of the electric type, of which the driven shaft is provided with a pinion driving a belt 106 surrounding a gear-reduction pulley or wheel 107 borne by the base S, preferably by means of an axis of transmission rotation DD' perpendicular to said base and parallel to axis BB'. Wheel 107 supports a movement transforming mechanism 108 comprising a support 109 immobilized on the wheel or pulley 107, so as to be able to be animated by this latter by a reciprocating angular displacement on the axis of rotation of the pulley. Support 109 bears three threaded rods 110, 111 and 112 each adapted to be driven in rotation on its axis by an actuation knob 113, manual or not. The screws 110, 111 and 112 extend parallel to one another in a general direction parallel to axis AA' and are made in the manner of micrometer screws.

The threaded rods 110, 111 and 112 cooperate respectively with a traveller 114, 115 and 116 in the form of a tapped ring capable of being displaced thus along the corresponding threaded rod by the rotation imparted to this latter by the control knob 113.

Transmission system III is constituted by rigid rods 120, 121 and 122 which are mounted by articulation pins 123, 124 and 125 on the corresponding travellers 114, 115 and 116. Rods 120, 121 and 122 are, furthermore, mounted by their opposite terminal part respectively on the sole-holder 2 or the base stirrup 3, on the intermediate stirrup 4 and on the articulation pivot 103. According to a preferred embodiment, the rod 121 is connected to a crank 126 fixed on a pin 127 borne by column 104 and provided with a pinion 128 cooperating with a complementary pinion 129 fitted on the terminal part of the constituent shaft of the articulation pivot 103 opposite sole 1. Pinions 128 and 129 constitute a bevel gear in the present case.

The construction of the apparatus as described hereinabove makes it possible to have available an articulated sole system I which is particularly compact and resistant, since it is borne by a suspension piece coupled to the through shaft of the articulation pivot 103. The sole 2 is then bereft of connection with axis CC' and its adaptation on the sole-holder 2 may thus be changed very rapidly whenever it is necessary to adapt the apparatus to the morphological conformation of the subject having to be mobilized. The suspension of the articulated sole system I enables a compact but robust articulated assembly to be obtained by adopting, for constituting the pivot 13 and the pivot 103, mechanical means well known for their sensitivity, their precision, concentricity such as needle or roller bearings.

By resorting to a movement transforming mechanism 108 with angular displacement, micrometer screws 110, 111, 112 may be used, which offer a considerable possibility of fine adjustment of each movement transmitted by the rods 120, 121 and 122 along axes AA', CC' and BB' respectively in the manner of an adjustable throw crank.

Figure 17:
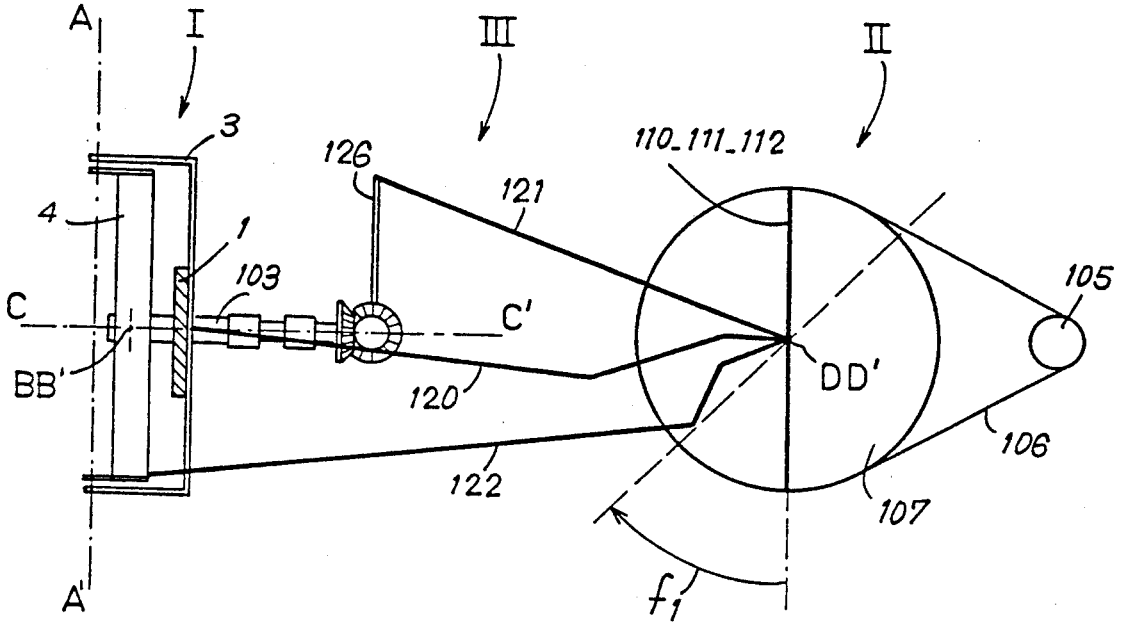
FIGS. 17 and 18 are schematic plan views showing two characteristic positions of the operation of the object according to FIG. 15.

In fact, FIG. 17 shows a state in which, by rotation of screws 110 to 112, the followers 114 to 116 have been aligned with axis DD' of partial angular rotation of pulley 107. In such a state adapted for the mobilization of a right foot as shown, any angular displacement of this pulley, for example in the direction of arrow $f_1$, via the motor 105, produces no movement of the articulated sole system I. The points of application of the different rods centred on axis DD' are, in fact, not modified by the rotation, whatever the angular amplitude of this latter. Such a functioning is, in particular, rendered possible via the connecting pins 123 to 125 between the rods and followers.

Figure 18:
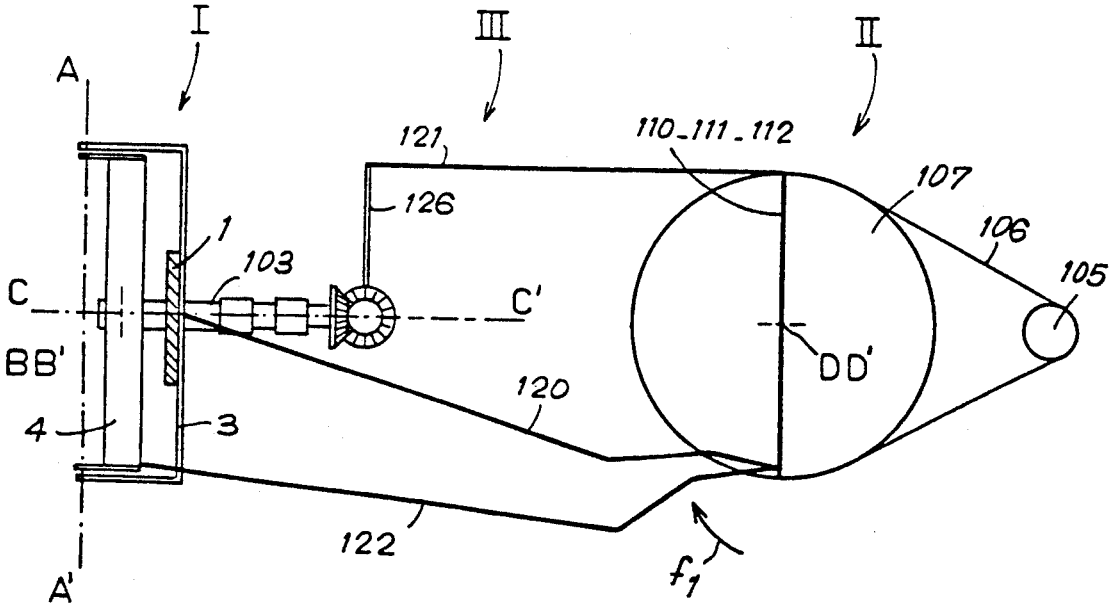

On the contrary, when the travellers have been guided in maximum displacement in the direction corresponding to the possible active adjustment stroke from the neutral point in alignment with axis DD', as illustrated in FIG. 18, a rotation in the direction of arrow fl of the wheel or pulley 107 is translated by a simultaneous actuation of the rods 120, 121 and 122 each controlling respectively the movement in dorsal flexion of the sole 1 via the base stirrup 3, the movement in abduction by rotation of the suspension piece 100 on axis CC' via the bevel gear 128, 129 and the movement in valgus by the drive in rotation of the intermediate stirrup 4 on axis BB'.

A drive in rotation of pulley 107 in the direction opposite that of arrow $f_1$ produces the simultaneous movements of plantar flexion, of adduction and of varus.

By the means carried out described hereinabove, it therefore becomes possible to adjust individually the amplitude of each movement of mobilization having to be imposed on the foot, by acting for example manually on knob 113 of the corresponding micrometer screw. Such an adjustment may occur easily and precisely, by reason of the accessibility to the mechanism 108 and the precision of fine adjustment which may be made to the respective position of the followers 114 to 116 displaced precisely between the two positions above.

It should be noted that it appears advantageous to provide screw 110 with a thread extending over the whole of the useful length, whilst a thread over only half of the length of screws 111, 112 may be provided. In this way, as shown from the description and drawings, the same apparatus may then be used for a left or right foot by simple displacement of the traveller 114 on one or the other of the useful areas of screw 110 on either side of axis DD' and reversal of the direction of rotation of motor 105, so that the previously described movements of valgus and of abduction of a right foot become movements of varus and adduction of a left foot.

Another advantage of the above structure resides in the simplicity of movement transmission ensured via the assembly of rods controlled by the transformation mechanism 108.

The above means consequently make it possible easily to adapt the mobilization apparatus to the treatment to be conducted and also to the morphology of the patient.

The particular construction of the apparatus offers the additional possibility of allowing the passive mobilization of the fore-foot with a view to correcting the deformation of metatarsus-adductus.

Figure 20:
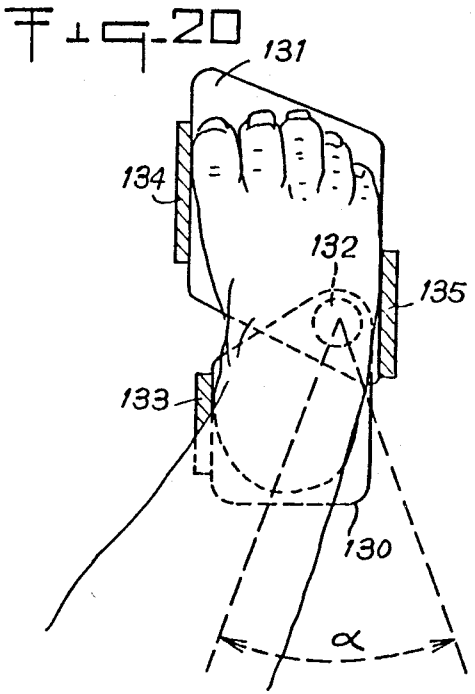
FIG. 20 is a side view illustrating a constructive detail according to FIG. 19.
Figure 19:
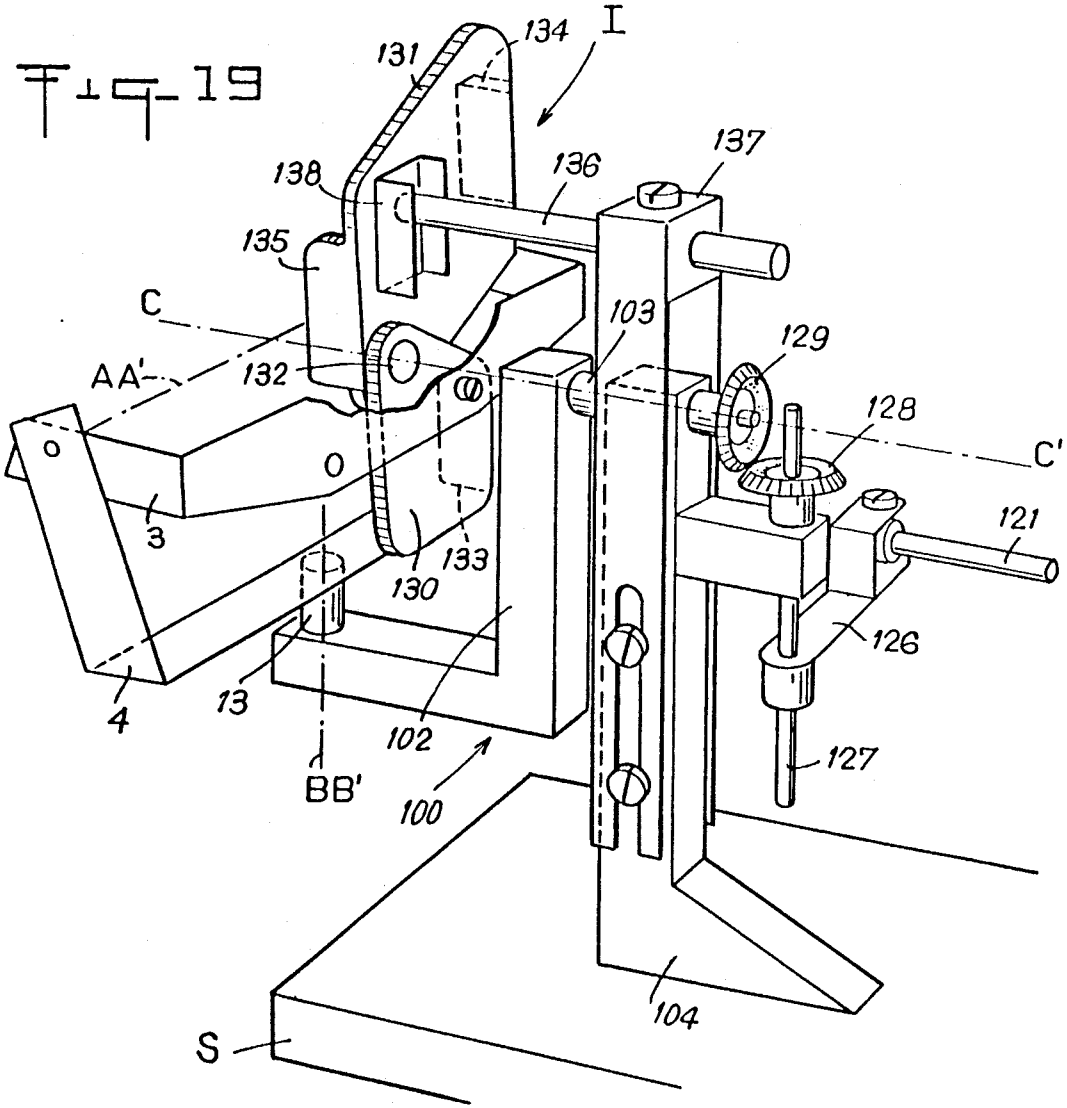
FIG. 19 is a partial perspective view illustrating a variant embodiment of certain of the constituent elements of the object according to FIG. 15.

To that end, as illustrated in FIG. 19, the articulated sole assembly I comprises a sole 1 which is constituted by a posterior part 130 immobilized by any appropriate means on the base stirrup 3. The posterior part 130 bears a front part 131 via an articulation pin 132 which is offset in the direction of the outer lateral edge, so as to be, in any case, disposed coaxially to pivot 103 centred on axis CC'. As illustrated in FIG. 20, the posterior part 130 presents a postero-internal raised edge 133, whilst the front part 131 is provided with an antero-internal raised edge 134 and an external median edge 135.

Edges 133, 134 and 135 make it possible to maintain in place a foot in a position of static, but also possibly dynamic, immobilization tending to mobilize the front part of the foot. In fact, as illustrated in FIG. 19, the front part 131 may be blocked angularly via a bar 136 adjustably fitted on the column 104 or on a telescopic extension 137 of the latter, so as to engage a complementary stop 138 borne by the front part 131. In this way, after adjustment of the transformation mechanism 108 for neutralizing the controls in plantar-dorsal flexion and varus-valgus via rods 120 and 122, an angular rotation of the pulley or wheel 107 rotates the suspension piece 102 on axis CC'. The suspension piece 102 drives the posterior part 130, whilst the front part 131 remains immobilized via the bar 136. In this way, as illustrated in FIG. 20, it becomes possible to mobilize, angularly and alternatively, for example over area $\alpha$, the posterior part 130 of the sole 1 and to mobilize the foot in metatarsus-adductus.

Figure 21:
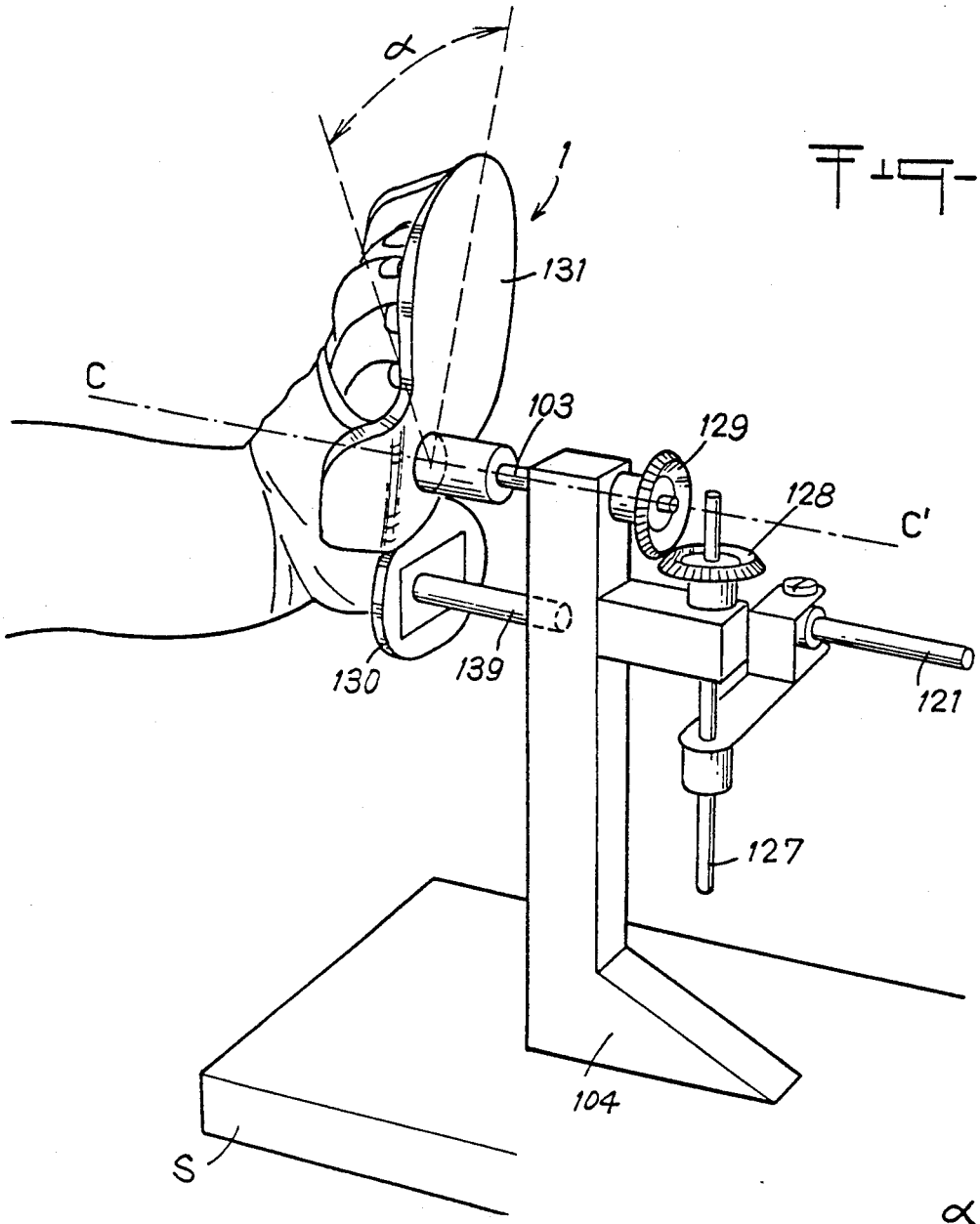
FIG. 21 is a partial perspective view of another partial embodiment of the object of the invention.
Figure 22:
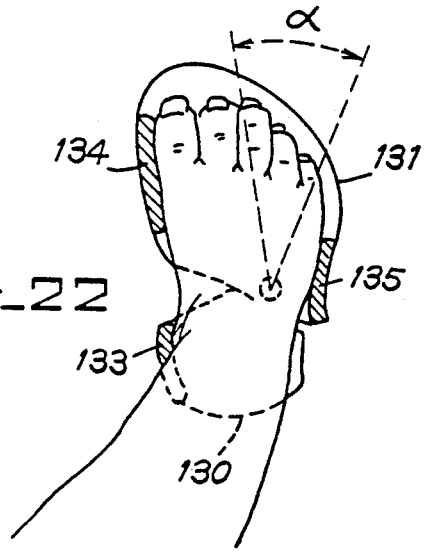
FIG. 22 is a partial side view showing a constructive detail of FIG. 21.

A variant embodiment is illustrated in FIGS. 21 and 22 showing a sole 1 made, as stated above, to comprise a posterior part 130 and a front part 131 provided with the same internal and external edges as those described with reference to FIG. 20.

In the example illustrated, the front part 131 is adapted to be angularly immobilized on the through shaft of the articulation pivot 103, whilst the posterior part 130 may be angularly immobilized via a bar 139 engaging the column 104. In this embodiment, the mobilization of the fore-foot in metatarsus-adductus is then ensured by subjecting the front part 131 to an angular displacement relatively to the immobilized posterior part 130 on which the front part is also articulated via pin 132.

INDUSTRIAL APPLICATION

The invention finds a preferred application in the manufacture of apparatus for re-education or continuous passive mobilization of talipes.

I claim:

1. Apparatus for passive articular mobilization of a foot, comprising:

a base;

a sole element;

articulation means for supporting the sole element upon the base for independent articulation about three orthogonal axes comprising a varus-valgus axis (B—B') extending generally perpendicular to the base, a flexion axis (A—A'); an abduction-adduction axis (C—C') intersecting both the varus-valgus and flexion axes and extending generally parallel to the base;

a single reversible drive motor mounted on said base;

a transmission means mounted on said base for connecting the drive motor to the sole element and for reversibly moving the sole element selectively and simultaneously about said three orthogonal axes in response to motor actuation with the moving of the sole element being independently variable, relative to motor actuation about said three orthogonal axes and wherein the movement of the sole element about any of the three orthogonal axes in response to motor actuation is adjustable to zero motion;

said transmission including a carriage supported on the base, said drive motor moving said carriage rectilinearly generally parallel to said base.

2. Apparatus as claimed in claim 1, said transmission means comprising transmission levers connected between said carriage and said articulation means for transmitting drive motor motion selectively through said articulation means, said transmission levers including a varus-valgus motion transmission lever for moving the articulation means about said varus-valgus axis; a flexion motion transmitting lever moving the articulation means about said flexion axis and an abduction-adduction motion transmitting lever for moving said articulation means about said abduction-adduction axis.

3. Apparatus as claimed in claim 2 wherein at least said varus-valgus and flexion motion transmitting levers are adjustably connected to said carriage by means for varying the effective length of the last-said levers between said carriage and said articulation means.

4. Apparatus as claimed in claim 2 wherein said articulation means comprises a first support connected to the sole element and pivotable about said varus-valgus axis, said varus-valgus motion transmitting lever connected to said first support; a second support connected to the sole element and mounted on said first support for pivotal motion about said flexion axis; said flexion motion transmitting lever connected to said second support; a third support connected to the sole element, said third support pivotable about said abduction-adduction axis; said abduction-adduction motion transmitting lever connected to said third support.

5. Apparatus as claimed in claim 4, wherein said second and third supports are connected to and carried by said first support, and said first support is mounted on the base for movement about said abduction-adduction axis.

6. Apparatus as claimed in claim 1, said transmission means comprising transmission levers connected between said carriage and said articulation means for transmitting drive motor motion selectively through said articulation means, said transmission levers including at least a varus-valgus motion transmitting lever for moving said articulation means about said varus-valgus axis, and a flexion motion transmitting lever for moving the articulation means about said flexion axis; an abduction-adduction lever connected to the sole element; and means for moving the abduction-adduction lever about the abduction-adduction axis when the sole element is moved about the varus-valgus axis.

7. Apparatus as claimed in claim 6, said means for moving the abduction-adduction lever comprising a flexible cable system connected between the abduction-adduction lever and the base.

8. Apparatus as claimed in claim 7, said flexible cable system including resilient means for enabling the cable length to vary under a spring bias from a normal predetermined length.

9. Apparatus as claimed in claim 8, said cable system connected to said lever by a variable throw crank system pivotable about said abduction-adduction axis.

10. Apparatus as claimed in claim 1, wherein said sole element includes a front part and a rear part, one of said front and rear parts being mounted to said articulation means for pivotal movement relative to the other part about said abduction-adduction axis.

11. Apparatus as claimed in claim 10, wherein said abduction-adduction axis is located toward the external median part of the sole element.

12. Apparatus as claimed in claim 10, including means for restraining movement of said front part relative to said base, and said rear part is pivotable about said abduction-adduction axis.

13. Apparatus as claimed in claim 12, wherein said abduction-adduction axis is located toward the external median part of the sole element.

14. Apparatus as claimed in claim 10, including means for restraining motion of said rear part relative to said base and said front part is pivotable about said abduction-adduction axis.

15. Apparatus as claimed in claim 14, wherein said abduction-adduction axis is located toward the external median part of the sole element.

16. Apparatus as claimed in claim 11, wherein said front part of said sole element includes an antero-internal raised edge and an external median raised edge, and said rear part includes a postero-internal raised edge.

17. Apparatus for passive articular mobilization of a foot, comprising:

a base;

a sole element;

articulation means for supporting the sole element upon the base for independent articulation about three orthogonal axes comprising a varus-valgus axis (B—B') extending generally perpendicular to the base, a flexion axis (A—A'); an abduction-adduction axis (C—C') intersecting both the varus-valgus and flexion axes and extending generally parallel to the base;

a single reversible drive motor mounted on said base;

a transmission means mounted on said base for connecting the drive motor to the sole element and for reversibly moving the sole element selectively and simultaneously about said three orthogonal axes in response to motor actuation with the moving of the sole element about independently variable, relative to motor actuation about said three orthogonal axes;

said transmission including a carriage supported on the base, said drive motor moving said carriage in rotation about a transmission axis extending generally vertically of said base, and wherein said transmission means comprises transmission levers connected between said carriage and said articulation means for transmitting drive motor motion selectively to said articulation means, said transmission levers including a varus-valgus motion transmitting lever for moving the articulation means about said varus-valgus axis; a flexion motion transmitting lever for moving the articulation means about said flexion axis and an abduction-adduction motion transmitting lever for moving said articulation means about said abduction-adduction axis.

18. Apparatus as claimed in claim 17 wherein at least said varus-valgus and flexion motion transmitting levers are adjustably connected to said carriage by means for varying the effective length of the last-said levers between said carriage and said articulation means.

19. Apparatus as claimed in claim 18, wherein said articulation means comprises a first support connected to the sole element and pivotable about said varus-valgus axis; said varus-valgus motion transmitting lever connected to said first support; a second support connected to the sole element and mounted on said first support for pivotable motion about said flexion axis; said flexing motion transmitting lever connected to said second support; a third support connected to the sole element, said third support pivotable about said abduction-adduction axis; said abduction-adduction motion transmitting lever connected to said third support.

20. Apparatus as claimed in claim 19 wherein said first and second supports are connected to and carried by said third support, and said third support is mounted to the base for movement about said abduction-adduction axis.

21. Apparatus as claimed in claim 18, wherein said means for varying the effective lengths of the varus-valgus and flexion motion transmitting levers includes means for varying the relationship between the last said levers and the transmission axis at the point where the last said levers are connected to said carriage.

22. Apparatus as claimed in claim 21, wherein said means for varying the effective lengths of the varus-valgus and flexion motion transmitting levers comprises variable throw cranks that are each pivotable about said transmission axis.

* * * * *